US008316756B1

(12) United States Patent
Woodell et al.

(10) Patent No.: US 8,316,756 B1
(45) Date of Patent: Nov. 27, 2012

(54) UPPER RECEIVER GAS CONTROL FOR DIRECT IMPINGEMENT FIREARMS

(76) Inventors: Phillip Lynn Woodell, Elgin, SC (US); Jenny Rebekah Woodell, Elgin, SC (US)

( * ) Notice: Subject to any disclaimer, the term of this patent is extended or adjusted under 35 U.S.C. 154(b) by 0 days.

(21) Appl. No.: 13/109,246

(22) Filed: May 17, 2011

(51) Int. Cl.
*F41A 5/28* (2006.01)

(52) U.S. Cl. ..... 89/193

(58) Field of Classification Search ..... 42/96, 90; 89/193, 191.01, 191.02, 192
See application file for complete search history.

(56) References Cited

U.S. PATENT DOCUMENTS

| | | | | |
|---|---|---|---|---|
| 2,748,662 | A * | 6/1956 | Simpson | 89/193 |
| 7,856,917 | B2 | 12/2010 | Noveske | |
| 2009/0199830 | A1 * | 8/2009 | Skilling | 124/3 |
| 2010/0095834 | A1 * | 4/2010 | Kuczynko et al. | 89/193 |

* cited by examiner

*Primary Examiner* — Michael Carone
*Assistant Examiner* — John D Cooper
(74) *Attorney, Agent, or Firm* — B. Craig Killough

(57) ABSTRACT

A gas control mounted in an upper receiver of a weapon. A valve communicates with a gas tube of the weapon to receive gas under pressure from the barrel of the weapon. The valve has a first orifice and a second orifice. The position of the valve is selectable between the first orifice and the second orifice by rotation of a knob positioned on an exterior surface of the upper receiver of the weapon. The orifices are of different sizes to allow regulation of the volume of gas flow to the receiver of the weapon.

10 Claims, 5 Drawing Sheets

UPPER RECEIVER GAS CONTROL FOR DIRECT IMPINGEMENT FIREARMS

FIELD OF THE INVENTION

This invention relates to firearms that comprise gas impingement actuated mechanisms.

BACKGROUND OF THE INVENTION

Some firearms use gases produced by ammunition as it is fired to actuate mechanisms within the firearm. More specifically, automatic and semi-automatic weapons use gas pressure produced from firing the weapon to automatically load ammunition. As the weapon is fired, gas pressure is harvested from the barrel of the weapon, and channeled by means of a conduit into the action of the weapon. The pressurized gas provides a source of energy to power a mechanism such as the automatic loading feature.

When noise suppressors are used with automatic and semi-automatic weapons, the gas pressure that is channeled rearwardly from the barrel or muzzle of the weapon increases. The gas also contains chemicals, such as ammonia, that are unpleasant to the senses of the shooter. The components of the gases also contribute to premature firearm parts failure, wear and tear. The increased pressure associated with the suppressor increases the volume, thereby increasing the amount of gas directed toward the action of the weapon and diffuser. The movement of the gas that is associated with the use of the suppressor creates an unpleasant experience for the shooter, while being detrimental to the weapon and the operation of the weapon.

There is a need for a device that will reduce the gas volume of direct impingement to the action of the weapon, as well as reduce the shooter's exposure to the gas. The device should be easy to switch to and from use with a suppressor to vary the volume of gas directed to the action according to use of a suppressor.

SUMMARY OF THE INVENTION

The present invention is a gas control mounted in an upper receiver of a weapon. A valve communicates with a gas tube of the weapon to receive gas under pressure from the barrel of the weapon. The valve has a first orifice and a second orifice. The position of the valve is selectable between the first orifice and the second orifice by rotation of a knob positioned on an exterior surface of the upper receiver of the weapon. The orifices are of different sizes to allow regulation of the volume of gas flow to the action of the weapon.

DETAILED DESCRIPTION OF PREFERRED EMBODIMENTS

Figure 1:
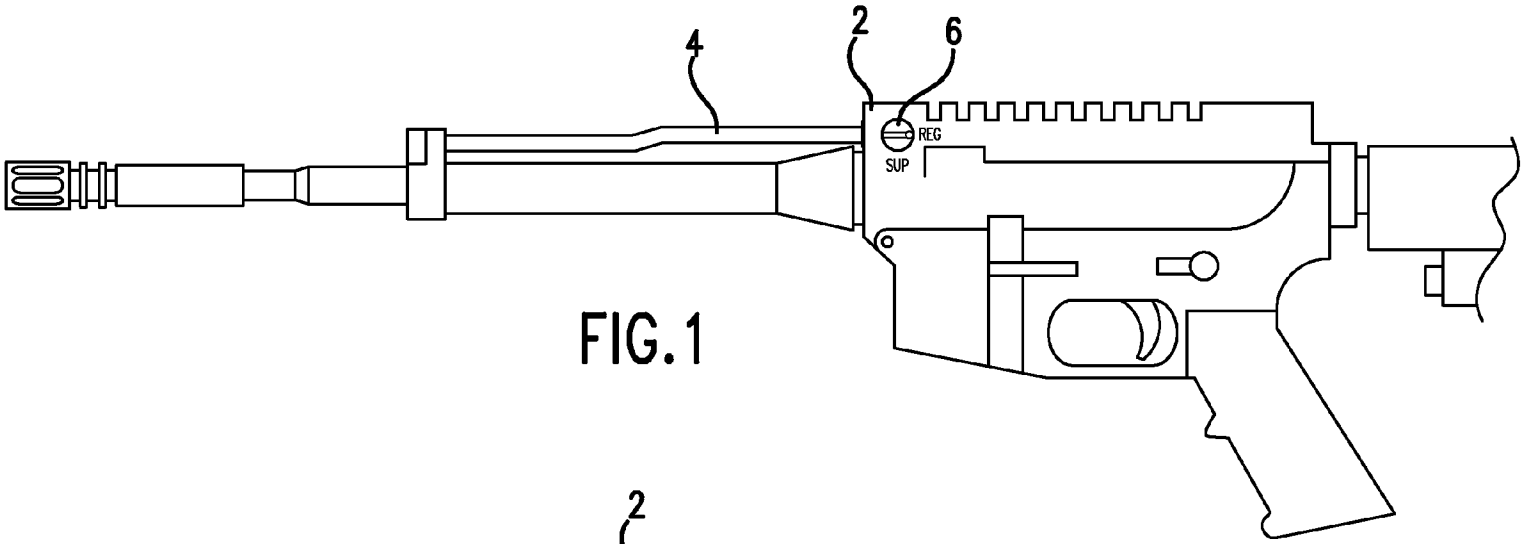
FIG. 1 is a partial, side elevation of an embodiment of an automatic weapon comprising the upper receiver gas control, with the gas control in the regular or normal position with no noise suppressor in use.
Figure 3:
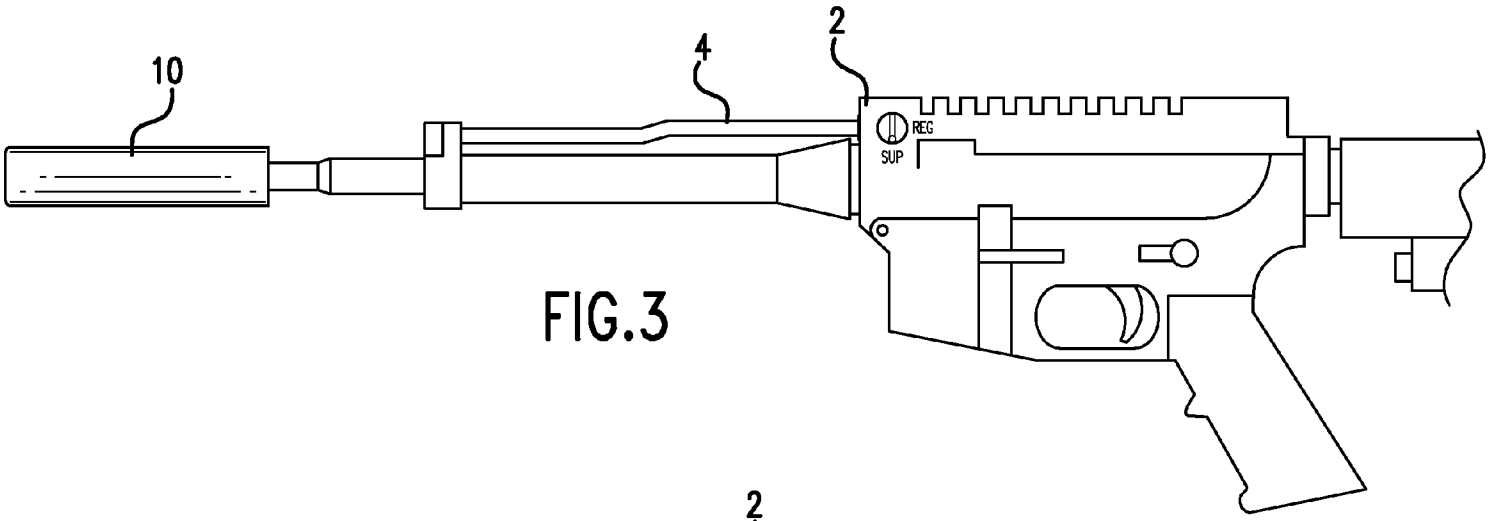
FIG. 3 shows the weapon of FIG. 1, with the gas control is positioned in the suppressor mode.

Turning now to the drawing figures, FIGS. 1 and 3 show an embodiment of the invention with the gas control mounted in the upper receiver 2 of an automatic or semi-automatic weapon such as an AR-15 or M-16. The gas control is mounted in the upper receiver, and in proximity of a gas tube 4 of the weapon. The gas tube receives pressurized gas from the barrel of the weapon as the weapon is fired and pressurized gas is produced within the barrel of the weapon. The knob 6 of this embodiment is positioned in the regular (REG) mode in FIG. 1, and in the suppressor (SUP) mode in FIG. 3. The regular mode is used when no suppressor is used with the weapon. The knob is positioned as shown in FIG. 3 when a suppressor 10 is used with the weapon. In this embodiment, the adjustment can be made simply by rotating the knob 90° from the suppressor position, or by reversing the direction.

Figure 5:
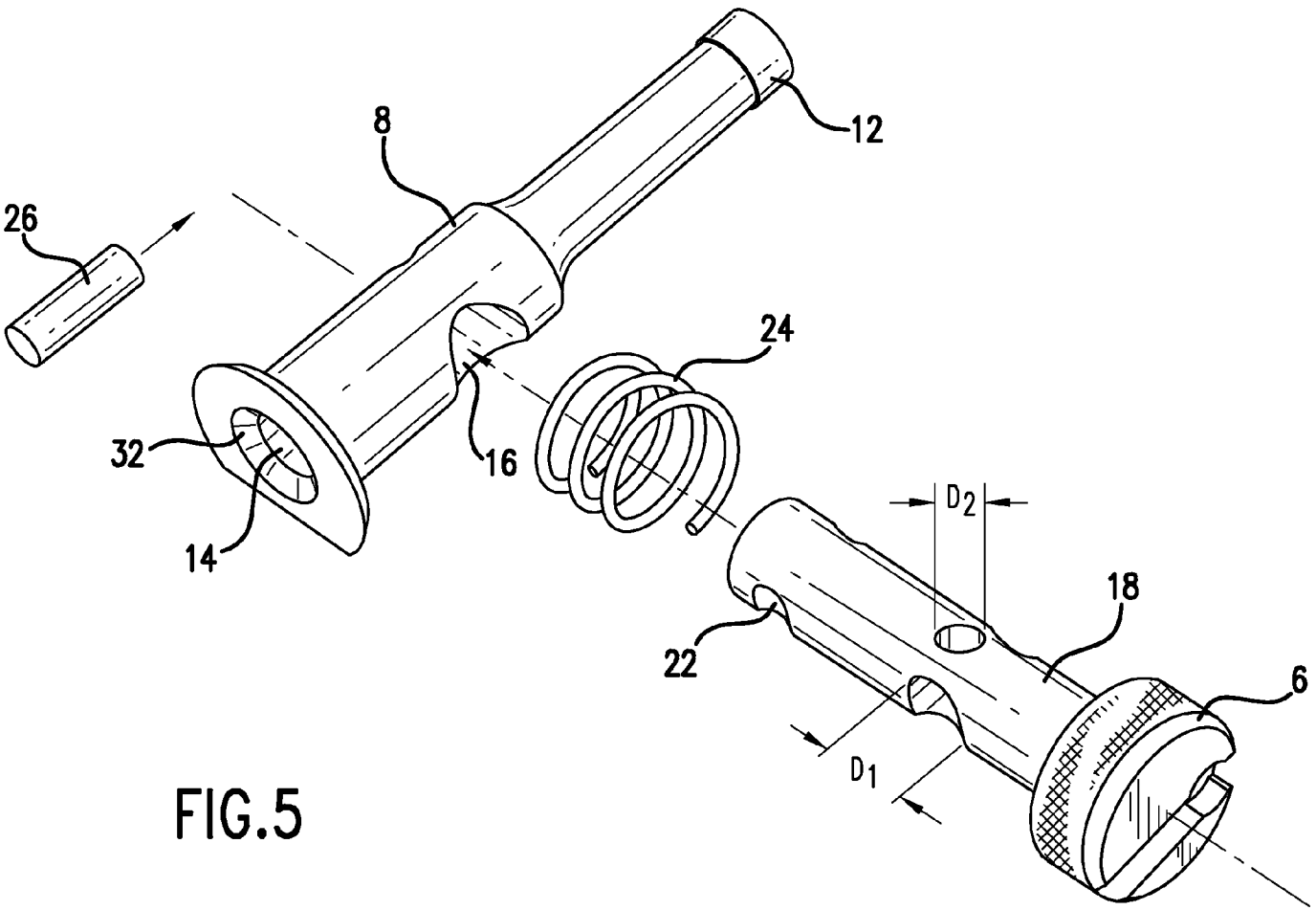
FIG. 5 is an exploded view showing elements of a preferred embodiment of the present invention.
Figure 6:
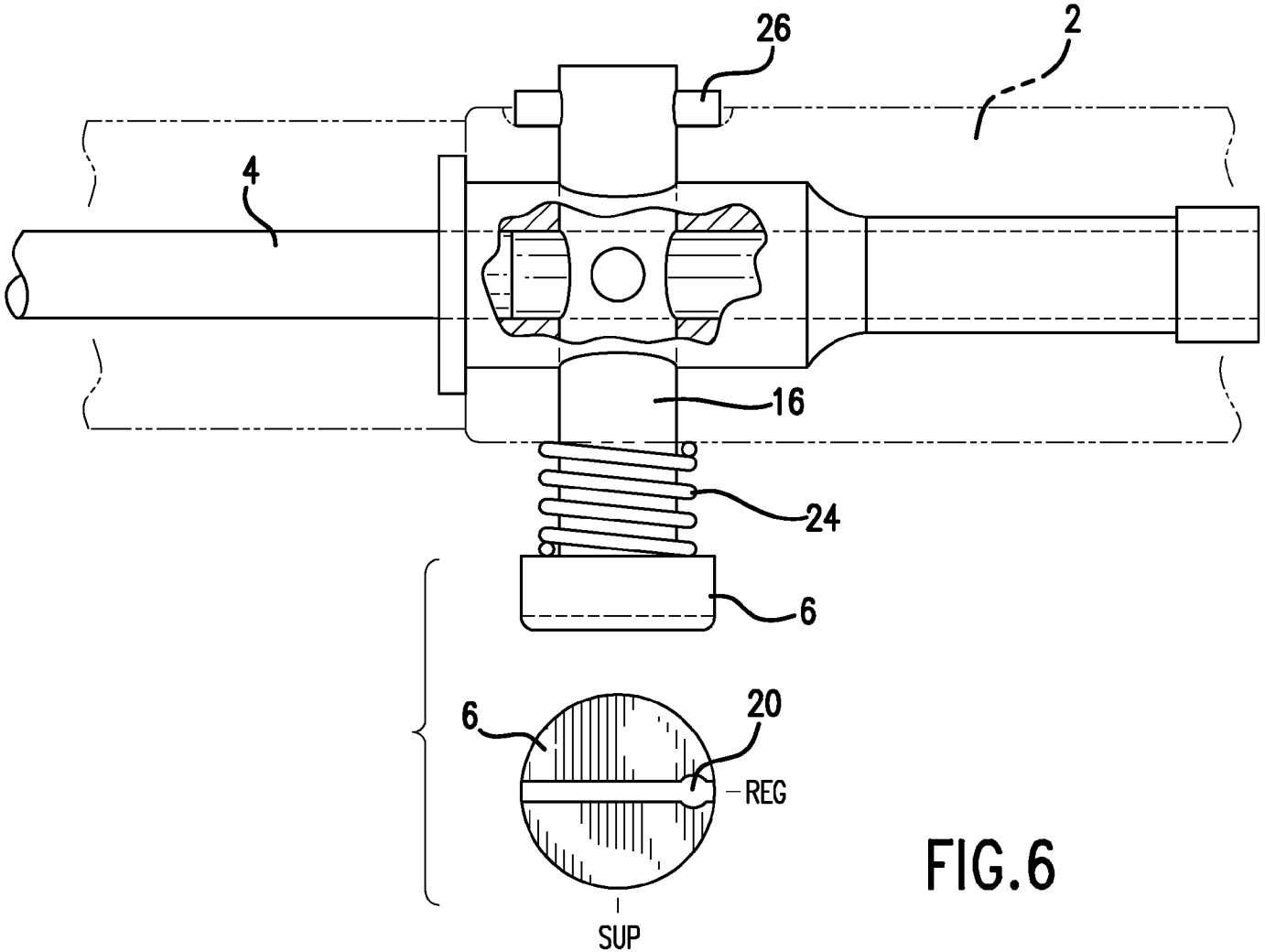
FIG. 6 shows the gas control of the present invention mounted in an upper receiver of a weapon such as an AR-15or M-16, with the upper receiver shown as a phantom. The gas control is positioned in the regular, or non-suppressor, mode.
Figure 7:
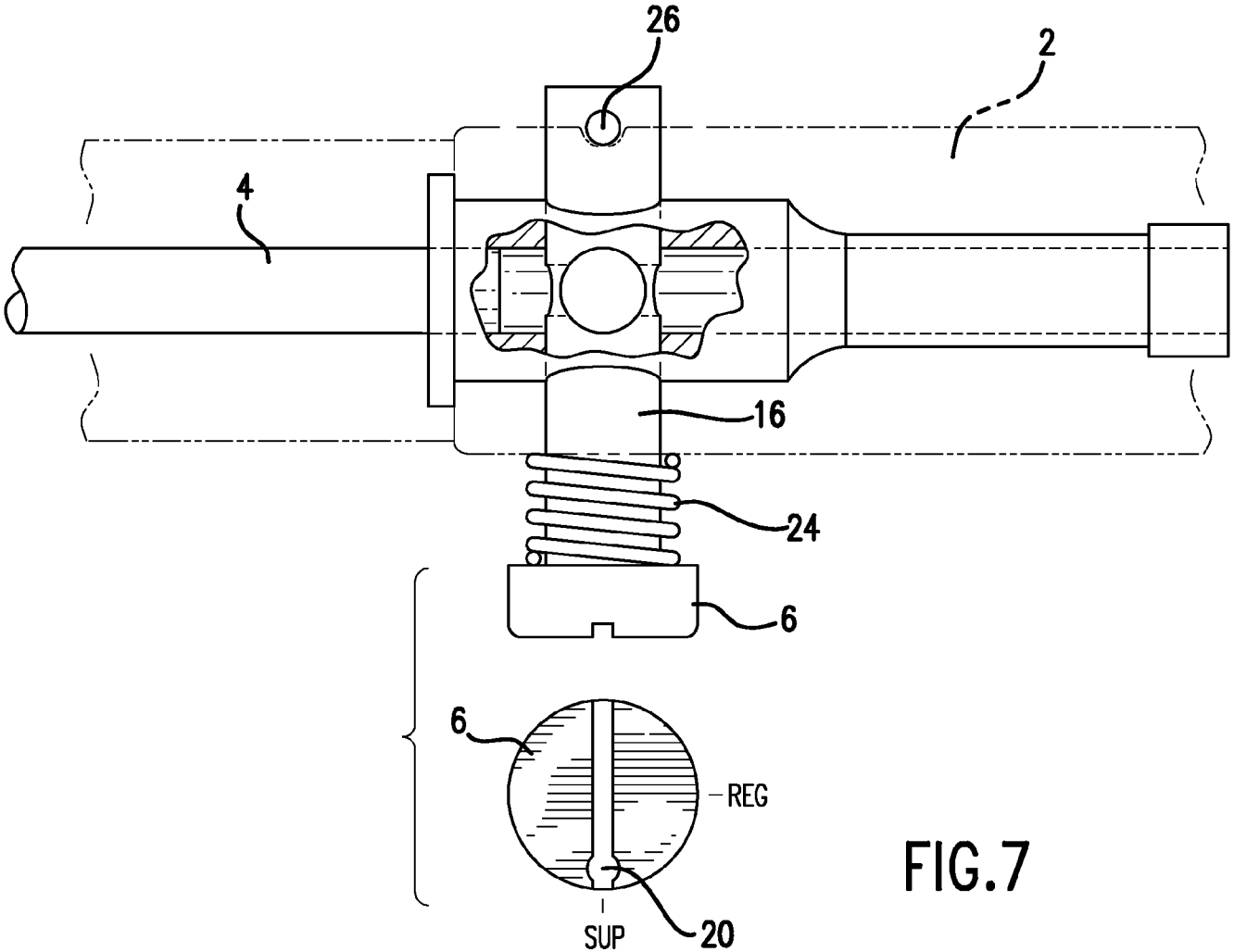
FIG. 7 shows the gas control of the present invention mounted in an upper receiver of a weapon, with the upper receiver shown as a phantom. The gas control is positioned in the suppressor mode.

Elements of a preferred embodiment of the invention are demonstrated in FIG. 5. The device comprises a housing 8 which acts as a conduit for receiving gas from the gas tube on one end. An opposite end of the housing and conduit is an outlet 12 that transmits gas to other conduits for transmission to the gas pressure operated actuator of the weapon. The housing therefore comprises a lumen 14 that extends from the inlet through the outlet.

A void 16 is formed in the housing that receives a regulator valve 18. The regulator valve may comprise a stem, which permits the regulator valve to be rotary in its operation. The stem may be elongated with a round cross section. The regulator valve has a first orifice D1 that extends completely through the stem of the valve. The regulator valve has a second orifice D2 that also extends through the stem of the valve. In the preferred embodiment, the first orifice and the second orifice are drilled or otherwise formed at 90° from each other, as is shown in FIG. 5. The regulator valve has knob 6 formed on an end thereof. The knob may have a slot formed through an end of the knob, and may also comprise a mark 20, or other indicia, formed therein, as shown in the drawings. The knob may have a knurled end for secure gripping of the knob by the shooter's hand.

Figure 2:
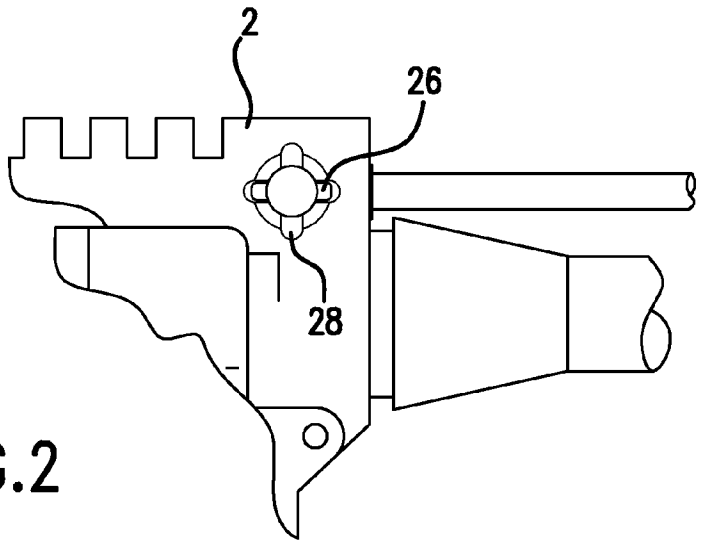
FIG. 2 is an enlarged, partial view of a weapon showing an obverse side of the weapon from FIG. 1, and showing the gas control positioned in an upper receiver of the weapon.
Figure 4:
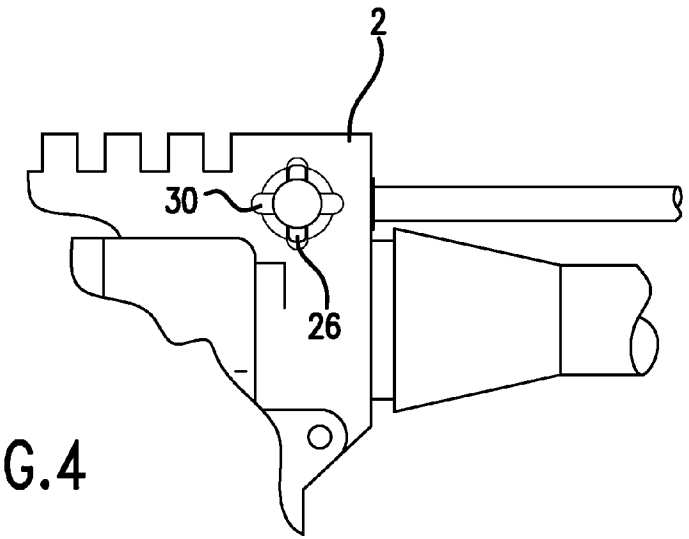
FIG. 4 shows the partial view of the weapon of FIG. 3, and shows the gas control in the suppressor mode.

The stem of the regulator valve has another orifice 22 that is formed or drilled through the stem near an end of the stem that is opposite the knob. This orifice receives a roll or retainer pin 26. The roll or retainer pin is inserted through the orifice, and prohibits the regulator valve from exiting the orifice formed in the housing when the device is assembled and mounted in the upper receiver. The spring 24 provides spring biasing to hold the roll pin within one of two slots 28,30 formed an exterior of the upper receiver. FIG. 2, FIG. 4.

The gas control is assembled in the upper receiver by forming or milling a hole in the upper receiver to receive the regulator valve. The inlet 32 of the housing is joined with the gas tube near where the gas tube enters the upper receiver. Once the housing is in place in the conduit system for the gas, the regulator valve is inserted through the spring, positioned in an interior of the upper receiver, and through the orifice formed in the housing for receiving the regulator valve. The regulator valve is properly aligned with the position markings (REG, SUP) formed on the exterior of the upper receiver. As the knob of the regulator valve is fully pushed toward the opposite side of the upper receiver, the orifice 22 formed near the end of the stem of the regulator valve exits the opposite side of the upper receiver, and the roll pin is inserted through the orifice. The pressure on the regulator valve may now be released, and spring biasing pushes the roll pin into one of the two slots 28,30 formed in the upper receiver.

The gas control may be retrofitted in existing weapons. In one embodiment, a portion of the gas tube is cut off and replaced with the gas control device. A hole is formed in the upper receiver for receiving the regulator valve, and slots are formed for receiving the roll pin as described.

In use, the shooter or other operator rotates the knob 90° to the REG position or SUP position, depending upon whether or not a suppressor is in use. If a suppressor is not in use, the weapon will not cycle, since the gas volume to the actuator is insufficient.

The regulator valve allows a larger volume of gas to pass to the actuator when the regulator valve is rotated to REG to align the larger diameter orifice D1 with the lumen in the housing. When the knob is rotated to the SUP position, the smaller orifice D2 is aligned with the lumen in the housing, thereby reducing the volume of gas that is transported from the barrel to the bolt or carrier key.

The knob may be repositioned by rotating the knob 90°. The knob may be pushed in slightly to disengage the roll pin from the slot. The knob is rotated, and engages the roll pin with the other slot corresponding to the desired position, and is held by spring biasing. The regulator valve is held in place with the selected first orifice or selected second orifice aligned with the lumen of the housing.

The device allows the shooter to quickly reduce the gas volume when the suppressor is in use. Associated unpleasant and undesirable gases directed toward the shooter are thereby reduced. If a shooter removes the suppressor from the weapon, increasing the volume of the gas for proper actuation of the weapon may be quickly performed.

What is claimed is:

1. An upper receiver gas control for a firearm, comprising a valve mounted in an upper receiver of a firearm, the valve comprising an inlet that communicates with a gas tube of the firearm, wherein the gas tube is constructed and arranged to receive gas under pressure from the barrel of the firearm, wherein the valve has a first orifice of a first larger size and a second orifice of a second smaller size, and wherein a position of the valve is selectable between the first orifice receiving gas from the gas tube of the firearm and the second orifice receiving gas from the gas tube of the firearm.

2. An upper receiver gas control for a firearm as described in claim 1, wherein the first orifice extends through a rotary member and the second orifice extends through the rotary member, and the position of the valve is selectable between the first orifice and the second orifice by rotation of the rotary member relative to the upper receiver.

3. An upper receiver gas control for a firearm as described in claim 1, wherein the first orifice extends through a rotary member and the second orifice extends through the rotary member, and the position of the valve is selectable between the first orifice and the second orifice by rotation of the rotary member relative to the upper receiver, and wherein the rotary member is held in a selected position relative to the upper receiver by spring biasing.

4. An upper receiver gas control for a firearm as described in claim 1, wherein the first orifice extends through a rotary member and the second orifice extends through the rotary member, and the position of the valve is selectable between the first orifice and the second orifice by rotation of the rotary member relative to the upper receiver, and further comprising a retaining pin that engages the rotary member near an end thereof, wherein the retaining pin selectively engages a first slot that corresponds to the first orifice or a second slot that corresponds to the second orifice in the upper receiver, wherein the retaining pin holds the rotary member in position relative to the upper receiver and in the first slot or the second slot, as selected, by spring biasing.

5. An upper receiver gas control for a firearm as described in claim 1, wherein the first orifice extends through a rotary member and the second orifice extends through the rotary member, and the position of the valve is selectable between the first orifice and the second orifice by rotation of the rotary member relative to the upper receiver, and further comprising a retaining pin that engages the rotary member near an end thereof, wherein the retaining pin selectively engages a first slot that corresponds to the first orifice or a second slot that corresponds to the second orifice in the upper receiver, wherein the retaining pin holds, by spring biasing, the rotary member in position relative to the upper receiver and in the first slot or the second slot as selected, and wherein spring biasing is provided by a spring that surrounds the rotary member near an end of the rotary member that is opposite the retaining pin.

6. An upper receiver gas control for a firearm as described in claim 1, wherein the first orifice intersects the second orifice at substantially a right angle.

7. An upper receiver gas control for a firearm as described in claim 1, wherein the first orifice extends through a rotary member and the second orifice extends through the rotary member, and the position of the valve is selectable between the first orifice and the second orifice by rotation of the rotary member relative to the upper receiver, and further comprising a retaining pin that engages the rotary member near an end thereof, wherein the retaining pin selectively engages a first slot that corresponds to the first orifice or a second slot that corresponds to the second orifice in the upper receiver, wherein the first slot and the second slot are formed in an exterior surface of the upper receiver, and wherein the retaining pin holds the rotary member in position relative to the upper receiver in the first slot or the second slot as selected by spring biasing.

8. An upper receiver gas control for a firearm as described in claim 1, wherein the gas control is positioned inline with the gas tube.

9. An upper receiver gas control for a firearm as described in claim 1, wherein the gas control is positioned near a point of intersection of the gas tube with the upper receiver.

10. An upper receiver gas control for a firearm as described in claim 1, wherein the gas control is positioned inline with the gas tube and the gas control is positioned near a point of intersection of the gas tube with the upper receiver.

* * * * *